US005364550A

United States Patent [19]

Manzo et al.

[11] Patent Number: 5,364,550

[45] Date of Patent: * Nov. 15, 1994

[54] LIQUID DETERGENT COMPOSITION

[75] Inventors: Robert P. Manzo, Chester, N.Y.; James Cavanagh, Ramsey, N.J.

[73] Assignee: Eastman Kodak Company, Rochester, N.Y.

[ * ] Notice: The portion of the term of this patent subsequent to Oct. 26, 2010 has been disclaimed.

[21] Appl. No.: 991,120

[22] Filed: Dec. 16, 1992

[51] Int. Cl.[5] ..... C11D 3/395; C11D 11/00; C11D 17/08; D06L 3/06

[52] U.S. Cl. ..... 252/102; 252/91; 252/95; 252/173; 252/174.13; 252/186.34; 252/186.36; 252/186.37; 252/DIG. 14

[58] Field of Search ..... 252/95, 99, 104, 173, 252/174.13, 186.34, 186.36, 186.37, DIG. 14, 102

[56] References Cited

U.S. PATENT DOCUMENTS

| | | | |
|---|---|---|---|
| 4,318,818 | 3/1982 | Letton et al. | 252/174.12 |
| 4,507,219 | 3/1985 | Hughes | 252/118 |
| 4,561,998 | 12/1985 | Wertz et al. | 252/547 |
| 4,913,828 | 3/1990 | Caswell | 252/88 |
| 5,145,684 | 9/1992 | Liversidge et al. | 424/489 |
| 5,209,863 | 5/1993 | Dixit | 252/94 |
| 5,256,328 | 10/1993 | Cavanagh | 252/102 |

*Primary Examiner*—Dennis Albrecht
*Attorney, Agent, or Firm*—J. Jeffrey Hawley

[57] ABSTRACT

The present invention is directed to a liquid laundry detergent comprising an aqueous dispersion of particles of at least one halogen donating compound wherein said halohydantoin particles have a surface modifier adsorbed on the surface thereof in an amount sufficient to achieve a particle size of less than about 400 nanometers (nm). The compositions of the present invention contain other conventional ingredients in laundry detergent compositions such as enzymes, surfactants, builders and other similar ingredients.

5 Claims, No Drawings

LIQUID DETERGENT COMPOSITION

FIELD OF THE INVENTION

The present invention relates to heavy duty liquid laundry detergent compositions.

BACKGROUND OF THE INVENTION

The heavy duty liquid detergent market has long searched for a way to combine the bleaching activity of hypochlorite bleach with heavy duty liquid detergents in a single formulation. This would make washing one's clothes and bleaching them easier because this would now be a single step process. The reason that this has not been successful to date is because hypochlorite is not chemically compatible with most surfactants. Attempts to combine bleach and cleaners have been made in some products. These use hydrogen peroxide as the bleaching agent. Unfortunately hydrogen peroxide is not a very good bleach for clothes and therefore does not perform very well. Some products have recently started to utilize perborates combined with an activator to produce small amounts of peracid in the wash liquor. This works to a moderate degree but still does not bleach to the level of hypochlorite. Still another attempt has been to add enzymes to act as the bleaching agent in some detergents. Again there is moderate activity but nothing to compare with hypochlorite.

SUMMARY OF THE INVENTION

The present invention is directed to a liquid laundry detergent comprising an aqueous dispersion of particles of at least one halogen donating compound wherein said halohydantoin particles have a surface modifier adsorbed on the surface thereof in an amount sufficient to achieve a particle size of less than about 400 nanometers (nm). The compositions of the present invention contain other conventional ingredients in laundry detergent compositions such as enzymes, surfactants, builders and other similar ingredients.

DETAILED DESCRIPTION OF THE INVENTION

The compositions of the present invention contain nanoparticles.

Nanoparticle dispersed halogen donating compounds of either bromine or chlorine derivation should be able to deliver the bleaching power of hypochlorite to the washing process as well as remaining stable in a heavy duty detergent mixture.

The halogen donating compounds are converted into an aqueous dispersion. These are not active at this point due to their low solubility. There will be a slight release of hypochlorous or hypobromous acid at this point even with low solubility.

This aqueous dispersion is added to a heavy duty liquid composition similar to those on the market today. Since this solution will be at an alkaline pH and contain a relatively high level of solids, the halogen donating compounds should remain relatively insoluble and inactivated.

Once this complete detergent/bleach mixture is added to a hot wash liquor, the halogen donating compounds should "activate" for several reasons. These reasons include a lower pH wash liquor, the hot water (100° F.–120° F.) and the high water dilution and agitation effects.

The actual bleaching component will be the hypochlorous or hypobromous acid which is produced by the halogen donating compound if the pH is below 7. Hypobromite or hypochlorite will be the bleach component if the pH is above 7.

The quantity of available active halogen donating compound should fall within the range of 20–500 ppm in the wash liquor for effective efficacy.

Useful halogen donating compounds include halohydantoins such as 1,3-dichloro-5 5-dimethylhydantoin, 1,3-dichloro-5-ethyl-5-methylhydantoin and 1-bromo-3-3-chloro-5-5-dimethylhydantoin. Commercially available compositions containing these hydantoins include Dantochlor TM RW and 8273 Dantoin TM 8-2-5 available from LONZA, Inc., Fair Lawn, N.J., calcium hypochlorite and other similar compounds.

The particles of this invention contain a discrete phase of a halogen donating compound as described above having a surface modifier adsorbed on the surface thereof. Useful surface modifiers are believed to include those which physically adhere to the surface of the halohydantoin but do not chemically bond to the halohydantoin.

Suitable surface modifiers can preferably be selected from known organic and inorganic excipients. Such excipients include various polymers, low molecular weight oligomers, natural products and surfactants. Preferred surface modifiers include nonionic and anionic surfactants. Representative examples of excipients include gelatin, casein, lecithin (phosphatides), gum acacia, cholesterol, tragacanth, stearic acid, benzalkonium chloride, calcium stearate, glyceryl monostearate, cetostearl alcohol, cetomacrogol emulsifying wax, sorbitan esters, polyoxyethylene alkyl ethers, e.g., macrogol ethers such as cetomacrogol 1000, polyoxyethylene castor oil derivatives, polyoxyethylene sorbitan fatty acid esters, e.g., the commercially available Tweens, polyethylene glycols, polyoxyethylene stearates, colloidol silicon dioxide, phosphates, sodium dodecylsulfate, carboxymethylcellulose calcium, carboxymethylcellulose sodium, methylcellulose hydroxyethylcellulose, hydroxypropylcellulose, hydroxypropylmethycellulose phthalate, noncrystalline cellulose, magnesium aluminum silicate, triethanolamine, polyvinyl alcohol, and polyvinylpyrrolidone (PVP). Most of these excipients are described in detail in the Handbook of Pharmaceutical Excipients, published jointly by the American Pharmaceutical Association and The Pharmaceutical Society of Great Britain, the Pharmaceutical Press, 1986, the disclosure of which is hereby incorporated by reference in its entirety. The surface modifiers are commercially available and/or can be prepared by techniques known in the art.

The surface modifier is adsorbed on the surface of the halogen donating compound in an amount sufficient to maintain an effective average particle size of less than about 400 nm. The surface modifier does not chemically react with the halogen donating compound or itself. Furthermore, the individually adsorbed molecules of the surface modifier are essentially free of intermolecular crosslinkages.

As used herein, particle size refers to a number average particle size as measured by conventional particle size measuring techniques well known to those skilled in the art, such as sedimentation field flow fractionation, photon correlation spectroscopy, or disk centrifugation. By "an effective average particle size of less than about 400 nm" it is meant that at least 90% of the particles have a weight average particle size of less than about 400 nm when measured by the above-noted techniques. In preferred embodiments of the invention, the effective average particle size is less than about 250 nm. In some embodiments of the invention, an effective average particle size of less than about 100 nm has been achieved. With reference to the effective average particle size, it is preferred that at least 95% and, more preferably, at least 99% of the particles have a particle size less than the effective average, e.g., 400 nm. In particularly preferred embodiments, essentially all of the particles have a size less than 400 nm. In some embodiments, essentially all of the particles have a size less than 250 nm.

The particles of this invention can be prepared by a method comprising the steps of dispersing a halogen donating compound in a liquid dispersion medium and applying mechanical means in the presence of grinding media to reduce the particle size of the halogen donating compound to an effective average particle size of less than about 400 nm. The particles can be reduced in size in the presence of a surface modifier. Alternatively, the particles can be contacted with a surface modifier after attrition.

These methods are described in detail in U.S. Pat. No. 5,145,684.

The relative amount of halogen donating compound and surface modifier can vary widely and the optimal amount of the surface modifier can depend, for example, upon the particular halogen donating compound and surface modifier selected, the critical micelle concentration of the surface modifier if it forms micelles, etc. The surface modifier preferably is present in an amount of about 0.1–10 mg per square meter surface area of the halohydantoin. The surface modifier can be present in an amount of 0.1–99.995%, preferably 20–60% by weight based on the total weight of the dry particle.

The halogen donating compound nanoparticles of the present invention can be incorporated into conventional liquid enzyme detergent compositions, as for example those disclosed in U.S. Pat. No. 4,318,818, the disclosure of which is incorporated herein. They may also be included in heavy-duty liquid detergents such as those disclosed in U.S. Pat. Nos. 4,507,219 and 4,561,998, the disclosures of which are incorporated herein. These compositions contain a wide variety of conventionally available detergent surfactants, cationic surfactants, zwitterionic surfactants, ampholytic surfactants, semipolar nonionic surfactants, enzymes, polycarboxylate builders, neutralizers and solvents.

For example, these compositions can contain a wide variety of components such as alpha olephin sulfonates, EO/PO block copolymers, optical brighteners, perborates, phospoates, peracids, nonylphenol surfactants, hydrogen peroxide, ethyl or isopropyl alcohol, amide surfactants, sodium lauryl sulfate, sodium lauryl ether sulfate, perfumes, coloring agents and metasilicate.

The present invention can be illustrated by the following representative examples.

EXAMPLE 1

| | % Wt. |
|---|---|
| Water | 55.0–65.0 |
| Dodecylbenzene Sulfonate (or longer chain) | 15.0–22.0 |
| Ethoxylated Fatty Alcohol | 3.0–6.0 |
| Amine Oxide | 1.0–5.0 |
| Sodium Citrate | 2.0–6.0 |
| Propylene Glycol | 2.0–6.0 |
| Enzymes and Enzyme Builders | 0.5–4.0 |
| Nanoparticle suspension of halohydantoins (10% active) | 1.0–6.0 |

EXAMPLE 2

| | % Wt. |
|---|---|
| Water | 65.0–80.0 |
| Ethoxylated Fatty Alcohol (Neodol 23-6.5) | 4.0–10.0 |
| Sodium Silicate | 1.0–5.0 |
| Sodium Sulfate | 0.1–3.0 |
| Sodium Xylene Sulfonate | 1.0–5.0 |
| Nanoparticle suspension of halohydantoins (10% active) | 1.0–6.0 |

The foregoing specification, including the specific embodiments and examples is intended to be illustrative of the present invention and is not to be taken as limiting. Numerous other variations and modifications can be effected without departing from the true spirit and scope of the present invention.

We claim:

1. A liquid laundry detergent composition comprising an aqueous dispersion of particles of at least one halogen donating compound wherein said particles have at least about 0.1 mg, per square meter surface area of the halogen donating compound of a surface modifier adsorbed on the surface thereof in an amount sufficient to achieve a particle size of less than about 400 nanometers (nm) wherein said particles are present in an amount of from 1 to 6 weight percent of the composition and the water is present in an amount of from 55 to 80 weight percent of the composition and said surface modifier physically adjeres to the surface of the halogen donating compound but does not chemically bond to the halogen donating compound.

2. A composition as in claim 1 wherein the halogen donating compound is a halohydantoin.

3. A composition as in claim 1 wherein the halogen donating compound is calcium hypochlorite.

4. A composition as in claim 1 that further comprises at least one surfactant.

5. A composition as in claim 1 that further comprises a builder.

* * * * *